United States Patent [19]

Arrigoni

[11] Patent Number: 4,637,527

[45] Date of Patent: Jan. 20, 1987

[54] APPARATUS FOR DISPENSING PIGMENTS

[76] Inventor: Giordano Arrigoni, Via Marconi 47, Cassano Magnago, Italy

[21] Appl. No.: 572,860

[22] Filed: Jan. 23, 1984

[30] Foreign Application Priority Data

Feb. 8, 1983 [IT] Italy ..... 19479 A/83

[51] Int. Cl.[4] ..... B67D 5/60

[52] U.S. Cl. ..... 222/144; 141/279

[58] Field of Search ..... 222/57, 58, 129, 132, 222/145, 144.5, 144, 130, 160, 162, 148, 506, 509; 141/100, 104, 105, 248, 279, 250; 294/106; 239/304, 305; 366/605

[56] References Cited

U.S. PATENT DOCUMENTS

| | | | |
|---|---|---|---|
| 2,367,031 | 1/1945 | Johnson, Jr. | 222/162 |
| 2,923,438 | 2/1960 | Logan et al. | 222/132 |
| 3,066,830 | 12/1962 | Heiss et al. | 222/144 |
| 3,168,967 | 2/1965 | Giampa | 222/144.5 |
| 3,723,851 | 3/1973 | Johnson et al. | 222/132 |
| 3,851,798 | 12/1974 | Miller | 222/144.5 |
| 4,019,653 | 4/1977 | Scherer et al. | 222/144.5 |
| 4,090,475 | 5/1978 | Kwan | 222/144.5 |
| 4,456,293 | 6/1984 | Panissidi | 294/106 |

FOREIGN PATENT DOCUMENTS 2609879 9/1979 Italy .

*Primary Examiner*—Charles A. Marmor
*Assistant Examiner*—Kenneth Noland
*Attorney, Agent, or Firm*—Abelman Frayne Rezac & Schwab

[57] ABSTRACT

A device for dispensing separate supplies of fluids has a circular array of valves which are moved selectively to position a selected one of the valves at the central axis of the array, the selected valve then being actuated to dispense a metered quantity of the fluid supplied to that valve, subsequent to which the selected valve is returned to its position in the circular array.

4 Claims, 5 Drawing Figures

APPARATUS FOR DISPENSING PIGMENTS

DESCRIPTION OF THE INVENTION

The present invention refers, in general, to the art of prepparation, distribution and storage of colours, understood in the widest meaning of the term.

More particularly, the present invention concerns the handling, the so-called "storage" and feed of colours conserved, in general, in the fluid condition with the use of solvents, thinners and others.

In the art of the sector this preparation and conservation has been known for considerable time. For example, but not critically, reference is made hereby to the application for an invention patent made in Italy on 28.9.1979 with No. 26098 A/79 and extended to foreign countries, at least to Great Britain and Holland, applications in respect of which the applicant to-date has received no information.

The context of these previous English and Dutch applications, the publication of which, at least in Great Britain should be made shortly is provided with the present re-transcribed text.

In general terms the art known to the Applicant refers to a distributor for colour storage and preparation plants characterised by including a series of rigid pipes, each connected to a colour storage tank via flexible pipes, hinged in the upper section to a rigid circumferential support and controlled in rotation, from the said support towards its centre, via pneumatic, oil-hydraulic pistons, or similar, a valve is located at the lower end of each rigid pipe, which has multiple, differentiated consecutive openings fitted with a gripping device in the upper section that can be inserted into a control yoke connected to the large number of pneumatic, oil-hydraulic, or similar control devices, relative to the multiple, differentiated openings of the said valves; the said controls and the said yoke being positioned at the centre of the said circumferential support and aligned with the lower discharge port of the structure, realised on the base cover constituting the collector, or drip tray. This previous distributor was characterised by having two photo-electric cells located at the side of each rotating rigid pipe to control the advance, or return stroke.

Other characterising particulars were also known to the said patent publication, which referred practically to the "distributor" aspect of the system, or assembly relative to the colour storage and preparation unit, always understood in the widest meaning. In the said previous patent publication made by the Applicant several drawbacks had been indicated presented by the devices and by the means used and known before the submission dates of the present patent application.

In particular, certain drawbacks were indicated among which: it was found difficult to completely eliminate dripping relative to the closure of the various valves, hence frequent dirtying of the colour residues, or of the colours introduced and handled lastly in the working area was found. This dirtying involved the flooring used by the workers assigned to the processing and handling.

Other drawbacks presented by the known distributors, which in general had circular sectors, or "carrousels" were that they had to be equipped with manual, or motor-driven rotation devices which obviously complicated the construction of the plant and made them more expensive.

These previous drawbacks were essentially removed by a distributor for colour storage and preparation plants substantially made up of a series of rigid pipes each connected to a colour storage tank via flexible pipes, hinged in the upper part to a rigid circumferential support and controlled in rotation by the said support towards the centre, via pneumatic, oil-hydraulic pistons, or similar devices; a valve which has multiple, differentiated consecutive openings is positioned at the lower end of each rigid pipe, fitted in the upper part with a gripping device that can be inserted inside a control yoke connected to the large number of pneumatic, oil-hydraulic, or similar devices, relative to the multiple, differentiated openings of the said valves; the said controls and yokes being arranged at the centre of the said rigid circumferential support and aligned with the lower discharge port of the structure, realised on the base cover which constituted the collector, or drip tray.

Substantially, the present invention refers to betterments to the variable and selective feed and metering assemblies for variously pigmented and/or mixed colours, for the preparation of dyes in general, the betterments of which include formation, on a stationary load bearing structure including at least a large number of selector control and selection means, as well as selective contribution ducts of at least one colour in the fluid condition and at least one valve group capable of feeding weight metered quantities; of at least one container, means to pre-determine and identify the weight, colour shade and possible colour, pigmentation mixture and similar conditions, a betterment consisting in the fact that the said stationary structure includes elements that are stationary, at least in part and mobile at least in another part so that the components ( typically, but not necessarily colours ) are transferred and selectively fed in perfectly centred conditions with respect to at least one part of the said stationary structure.

The assembly ( understood in the widest meaning ) forming the subject of the present betterments invention to the variable and selective feed and metering assemblies for colours, chromatic tints and hues in the pigmentation and colour combination and i.e. substantially the present invention in its entirety, concerns a large number of stationary and mobile components and elements, valve groups, as well as containers and means to pre-determine and identify the weight, coloration shade and/or the colour, pigmentation mixture and similar conditions.

These and other characteristics of the invention will be evident during the following detailed description of the invention, referred to the annexed drawings, in which:

FIG. 1 diagrammatically represents an assembly, in a vertical section and partial view, including stationary and mobile components, as well as two different types of valve groups and useable selectively depending on the convenience and service requirements, on the flow rate of the colours, or fluidified dyes to be fed, as well as the main circuit systems and the relative control and handling systems in a more schematic form and partial view;

Figure 1:
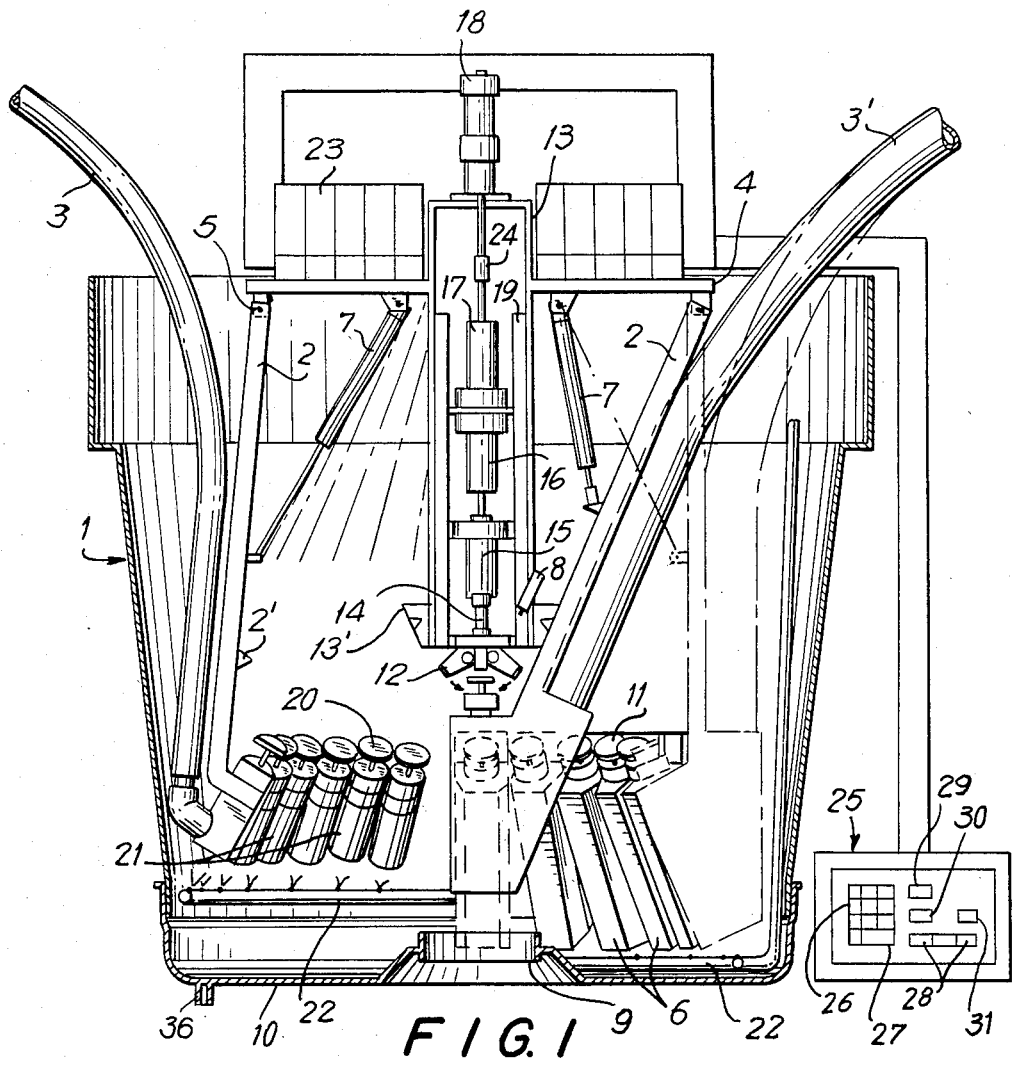
Figure 4:
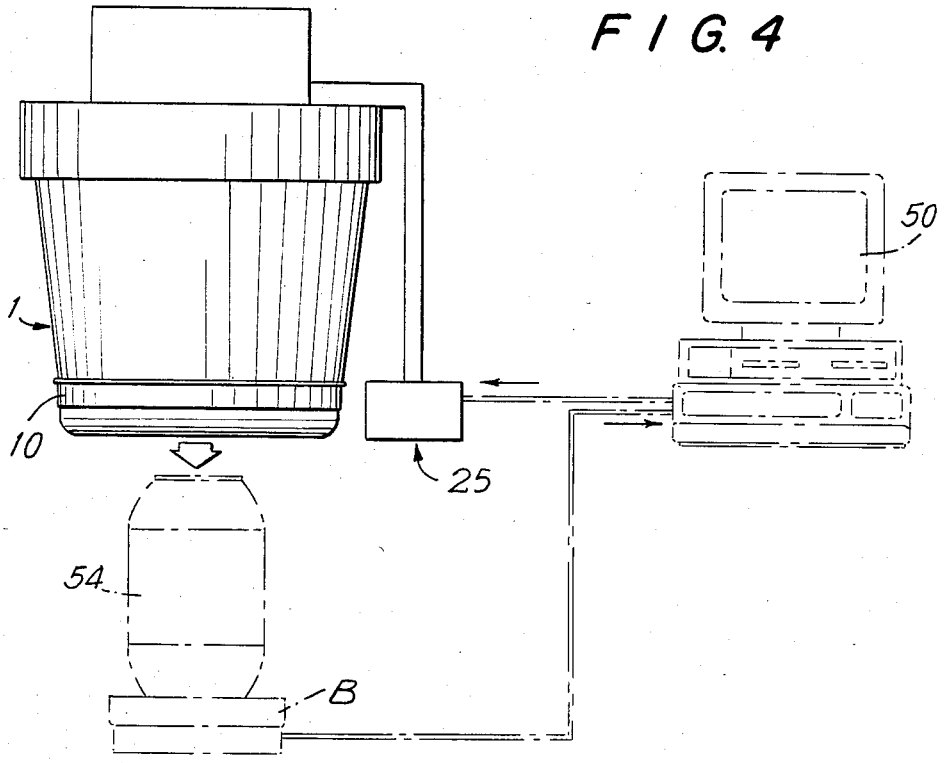
Figure 5:
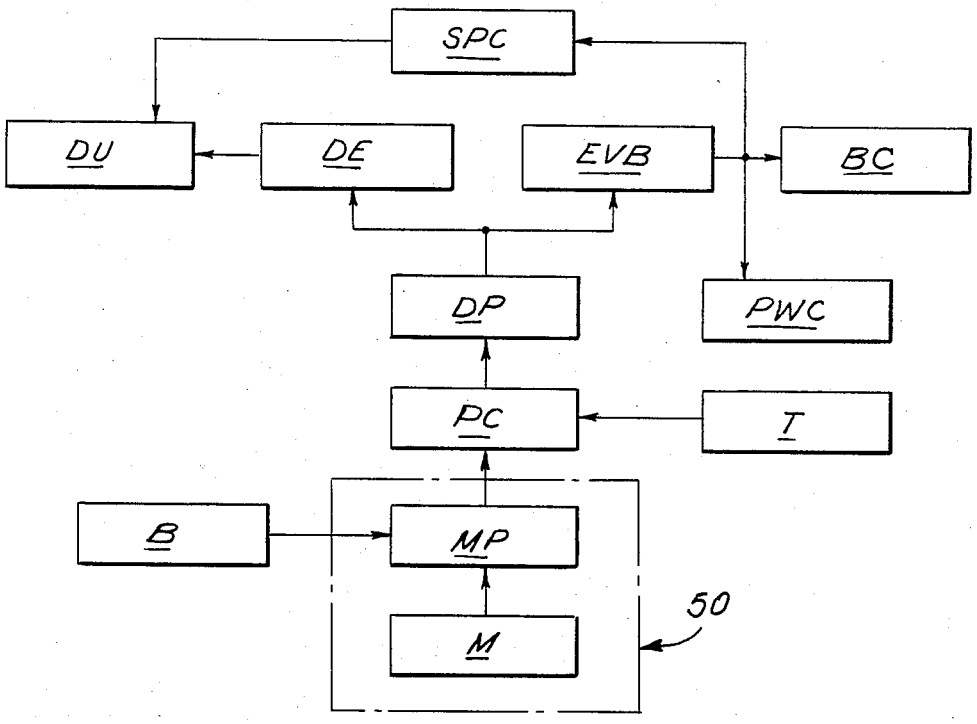

FIG. 4 represents the assembly in an exemplary form consisting of a handling and treatment unit, including a container associated with a gravimetric means to control the weight of any one of the colours to be metered, the same assembly being associated with a display control means of the type reproduced in FIG. 1 and FIG. 5 is a block diagram of the entire plant, preferably but not critically electronic.

BRIEF DESCRIPTION OF THE PREFERRED EMBODIMENT

With reference to the numerous non-limitative figures of the drawings and to facilitate understanding of the invention initially the diagram of FIG. 5 will be described. Obviously the combination of the elements of this diagram is not limitative and may have numerous variations and/or substitutions. In this diagram SPC is used to indicate a pneumatic selection circuit the pneumatic means of which are inter-connected to a pneumatic washing circuit PWC.

The power circuit is represented by the CP block connected to a keyboard T to obtain the necessary controls. The actual electronic means are assumed to be written in the rectangle 50, such as the micro-processor MP and at least one memory M.

The micro-processor MP is connected, in general piloted by a balance, or an equivalent gravimetric means B. Other components and groups are imagined as enclosed in the block DP which represents the distributor board, the weight of which is interlocked with the power circuit CP.

In the block diagram of FIG. 5 one metering solenoid valve and at least one metering unit DU are included non-limitatively from which it is derived in an exemplifying form from the pneumatic selection circuit SPC. One solenoid valve associated with at least one arm is indicated by EVB, which is also exemplifyingly associated with a cylinder arm unit BC.

The assembly of FIG. 1 includes stationary components, such as the outside container 1 which encloses other components stationary at least in part, such as incoming flexible pipes 3 and 3' for the fluidified colour.

As can be observed, the pipe 3 has, as represented, a smaller diameter, whereas pipe 3' has a larger diameter than the previous pipe 3.

Figure 2:
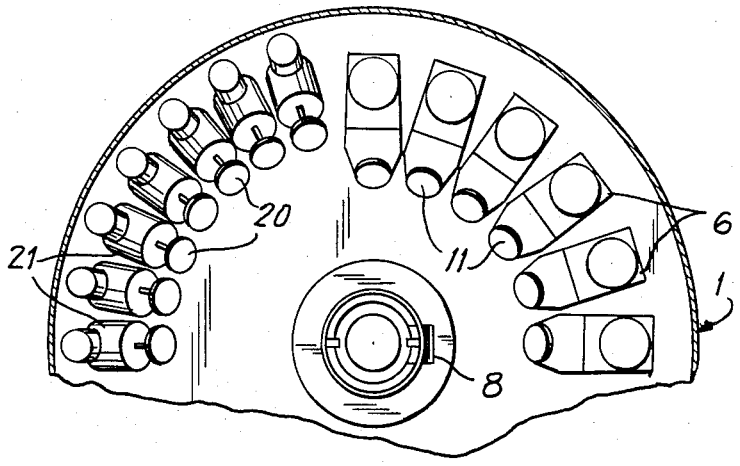
FIG. 2 represents the assembly of FIG. 1, fragmentarily and schematically in plan, with the exclusion of the said control circuit systems and means.

This different diameter is consistent with the sizes of the metering valves 21, pre-determined to meter a relatively small fluid flow and consistent with pipe 3' predetermined to feed metering valves 6 having a greater flow respectively. FIGS. 1 and 2 only represent metering valves with two different flows, but obviously the complex could involve three and even more differentiated flow metering valves the choice of which could be determined selectively. 2 indicates a structural support arm of the valve group units. 4 identifies a support possibly, but not critically circular, which supports the stationary components of the assembly (or of each assembly, in the event that the plant includes a large number of assemblies, proportional to the service potentiality and capacity of the same). 5 indicates a hinge which permits the necessary displacements which are at least favoured, if not directly controlled by a piston contained in a pneumatic, or oil-hydraulic cylinder 7. Since control requirements exist, in particular to centre the metering valves (only one of which is represented in FIG. 1), a sensor is foreseen 8, such as a photo-electric cell (or photo-resistor) suitably positioned in the assembly. 9 indicates the passage port of the dyes, integral with the "drip collector" 10 belonging to the stationary unit which includes the outside container 1. 11 indicates an adjustable grip pan for the large flow metering valves 6.

At least one of these metering valves is operatively associated with a gripping and opening yoke 12. 13 identifies the load bearing structure of the valve means, or more precisely of the fluid dynamic opening and closing means (cylinders) of the valve means.

The yoke control 12 is actuated by a cylinder 14, or other equivalent fluid-dynamic means. 15,16,17 and 18 identify the differentiated opening cylinder of at least one of the valves, or metering valve means. 19 identifies the side guides, between which the components contained in the structure 13 carrying the cylinders, or equivalent opening and closing fluid-dynamic means of the valve means are arranged respectively. 20 represents a selectively adjustable grip pan for the valve means which, in the example shown, are the relatively small flow versions, such as the valves 21. 22 identifies a characteristic part of the invention i.e. a duct which extends, or is associated with other ducts inside the drip collector 10 and which has a large number of nozzles, indicated schematically and through which oriented, positioned, or however directed jets are emitted towards the respective valve units to eliminate the fluid droplets of colour, or colours which could remain on the relative valve units by surface adhesion. These droplets may consolidate and become difficult to remove, in particular during the inactive period for example, over-night. 23 identifies a large number of solenoid valves associated with the plant, or assembly of FIG. 1.

The example of at least FIGS. 1 and 5 schematically reproduce the various control means of an assembly preferentially, but not critically electronic and typically 26 indicates a selection button of the valves to be used and 27 indicates a confirmation control of this selection. 28 indicates a selection control of the metered quantities, for example, a small or medium, or large metered quantity. 29 is a so-called display (optical representation) of the selected valve (or valves) and 30 identifies the zeroing control of this selection. 31 indicates the button, or equivalent means (also photoelectric) for the washing control, for example, but not critically, in the manual version.

FIG. 1 characteristically also includes a shaped projection 2' consisting of the arm 2 and capable of engaging in a consistent point of a corona 13' integral with the base of the load bearing structure of the valve means to assure the co-axiality of the various valve groups in the operative phase.

Figure 3:
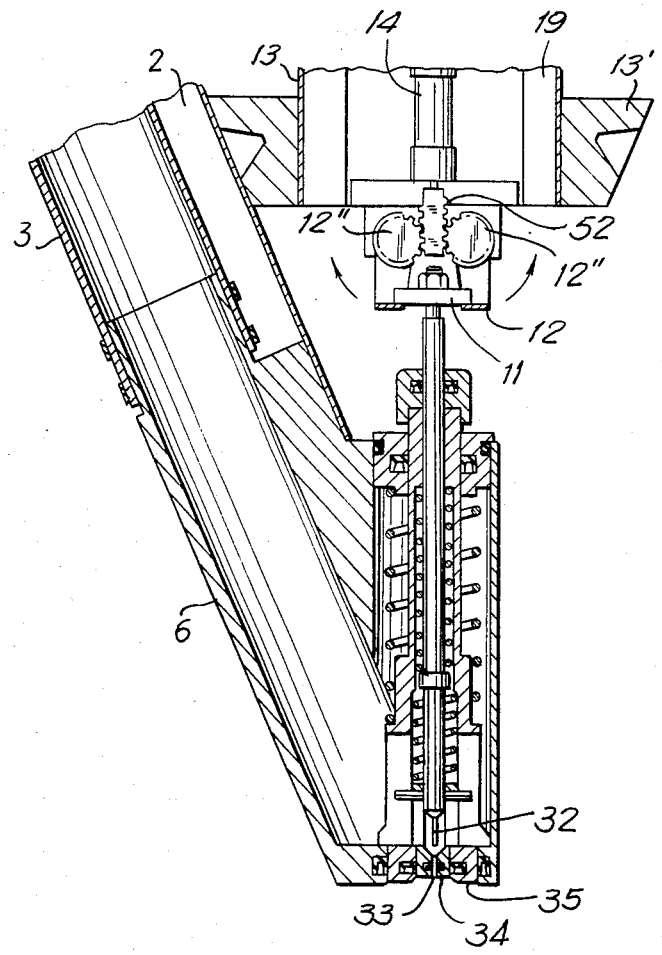
FIG. 3 represents one of the valve groups included in the assembly in section and to scale in greater detail.

In the detail of FIG. 3, the pan 11 clearly appears engaged by a yoke 12 ( moveable in the direction indicated by the arrows ) via gearing 12' and 12'' driven, for example by a rack 52, by the system that includes the cylinder 14. The valve unit is known in itself and includes, for example, a "small" 33, "medium" 34 and "large" 35 wedge orifice, as well as a washing discharge 36.

In FIG. 4 assembly 1 appears above a container 54 which acts on a balance B connected to the electronic board 50.

I claim:

1. Apparatus for dispensing metered quantities of a plurality of fluid materials, comprising:

plural metering valves arranged in a circular array about a central axis;

plural flexible fluid supply lines respectively connected to an associated one of said metering valves and respectively connected to a supply of one of said fluid materials;

plural guide and support members each carrying one of said metering valves, and movable between an advanced position in which the associated metering valve is substantially aligned with said central axis, and, a retracted position in which the associated metering valve is withdrawn from said central axis and repositioned within said circular array;

plural independent drive means, each said drive means being connected to an independent one of said guide and support members and for moving the associated guide and support member between said advanced and retracted positions;

means sequentially activating selected ones of said independent drive means; and an actuator means for operating said metering valves when in said advanced position, said actuator means being positioned in axial alignment with said central axis, and including gear driven gripping means activated by a rack under the control of a fluid actuated piston and cylinder arrangement.

2. The apparatus of claim 1, in which said guide and support members are pivotally suspended at their upper ends and carry said metering valves at their lower ends, and said respective drive means are connected to said support members intermediate the ends thereof.

3. The apparatus of claim 2, in which each said guide and support member includes means for interlocking with a member concentric with said actator when in the advanced position of said guide and support to prevent lateral displacement of said guide and support member when in that position.

4. The apparatus of claim 3, including an annular drip pan substantially concentric with and positioned beneath said array of metering valves, and having a central opening through which a said selected valve discharges, said drip pan having a drain for discharging drops falling from said metering valves when in the retracted position.

* * * * *